United States Patent [19]

Sloan et al.

[11] Patent Number: 5,046,962

[45] Date of Patent: Sep. 10, 1991

[54] CABLE TERMINAL ASSEMBLY

[76] Inventors: Bobby D. Sloan, 3-Bear Canyon Dr.; Kenneth R. Vaught, Jr., 129 April Point North, both of Montgomery, Tex. 77356

[21] Appl. No.: 509,781

[22] Filed: Apr. 17, 1990

[51] Int. Cl.[5] ..... H01R 4/70

[52] U.S. Cl. ..... 439/202; 439/522; 439/766

[58] Field of Search ..... 439/202, 522, 765, 766, 439/770, 774, 772; 384/474

[56] References Cited

U.S. PATENT DOCUMENTS

| | | | |
|---|---|---|---|
| 1,630,218 | 5/1927 | Rutherford | 439/766 |
| 1,788,089 | 1/1931 | Farrell, Jr. | 439/766 |
| 2,076,257 | 4/1939 | Vana | 439/766 |
| 2,239,891 | 4/1941 | Horger | 384/474 |
| 2,551,895 | 5/1951 | Noir | 439/202 |
| 2,622,120 | 12/1952 | Knasko et al. | 439/202 |
| 2,844,806 | 7/1958 | McKissick | 439/522 |
| 4,483,910 | 11/1984 | Julian | 429/179 |
| 4,938,706 | 7/1990 | Sykes | 439/202 |

*Primary Examiner*—Gary F. Paumen
*Assistant Examiner*—Kevin J. Carroll
*Attorney, Agent, or Firm*—Richard C. Litman

[57] ABSTRACT

A cable terminal assembly for battery posts includes interfitting inner and outer members provided with cooperating camming surfaces on the lower portions thereof so that when nested and the inner member is axially displaced downwardly, a positive clamping action is achieved about the battery post with a complete shrouding thereof. Openings and passageways within the two members communicate with one or more bores accessible from without the assembly to permit the injection of a suitable fluid substance designed to minimize corrosion following the filling of these openings and passageways with such substance which bathes the battery post and forms a seal or bead beneath the assembly. Tool engaging provisions on both members accommodate the use of wrenches or the like to relatively axially displace the members during attachment and removal of the assembly with a precise axial displacement being accomplished in view of cooperating threads connecting the nested members.

2 Claims, 2 Drawing Sheets

CABLE TERMINAL ASSEMBLY

FIELD OF THE INVENTION

This invention relates generally to cable terminals and more particularly, to an improved terminal assembly especially adapted for attaching electrical cables to battery posts or the like.

BACKGROUND OF THE INVENTION

The connection of cables to wet cell storage batteries inherently presents a problem of corrosion, particularly in the areas of the mounting posts of the battery. It is well recognized that the electrical field spanning the opposed polarity of the two battery posts, coupled with the ever present vapors as emitted by the acid electrolyte, encourage the formation of corrosion upon the posts and any terminals or connecting hardware utilized to affix the cables to the battery posts. The foregoing detriment frequently appears regardless of which type of common cable terminals are employed. The most common OEM battery cable terminal comprises a bifurcated member constructed of lead which is adapted to surround a battery post and be clamped thereto upon the tightening of a nut and bolt passing through the free ends of the terminal. Lead is chosen for its high conductivity and malleability, thus encouraging a tight conformability with the tapered configuration of battery posts. Such terminals often leave a gap adjacent the post and this exposed area usually becomes the first spot to be attacked by corrosion. Even with no gap formed as above, corrosion often occurs upon the associated steel bolt and nut as well as upon the exposed top of the battery post. To overcome the above, means must be provided to protect the entire environment surrounding the battery posts and their interface with the cable terminals.

DESCRIPTION OF THE RELATED ART

It is well recognized that corrosion of battery posts and terminals may be at least retarded by the application of a coating compound, such as grease, to all exposed components. This procedure comprises but a stop-gap measure, as it fails to completely enshroud all areas of the post and cable termination and therefore ultimately permits the formation and migration of corrosion, especially since a substantial area of the post remains exposed. U.S. Pat. No. 2,844,806 issued to McKissick suggests the application of a felt ring about a battery post, beneath the cable terminal and which is impregnated with oil and soda to combat corrosion. Experience has shown that in spite of such a device, corrosion will still occur. A later improvement in corrosion prevention appears in an assembly proposed in U.S. Pat. No. 4,483,910 issued to Julian and which is applicable to a battery post comprising a threaded member. The cable terminations are affixed upon the attachment of a nut to the post and thereafter a plastic housing is snapped over the assembly. Such an arrangement naturally requires a special threaded battery post and any leakage of acidic fumes past the housing interface could still attack the nut and post.

SUMMARY OF THE INVENTION

By the present invention an improved terminal for connecting cables to battery posts is provided and which achieves an enhanced mechanical attachment together with the formation of an all encompassing shroud and the inclusion of a protective vapor barrier as provided by grease or the like which is injected to bathe the battery post. The mechanical connection utilizes a two-part taper lock terminal with the two members threadedly engaging one another. By the use of a suitable conventional box, open-end or socket wrench upon at least one of the two terminal members, camming means in the form of engaging tapered surfaces on the two members are axially displaced relative one another to positively connect the terminal and its cable to the battery post. A grease fitting valve mounted through at least one of the two terminal members communicates with a chamber within the interior thereof, immediately adjacent the battery post such that upon the application of grease thereto, the chamber and communicating openings or passageways are filled with this grease. A plurality of openings through the wall of the innermost one of the two terminal members permits grease injected into the terminal assembly chamber to bathe the entire height of the battery post and to ooze from the bottom of the assembly whereupon this grease forms a bead or seal in the space intermediate the terminal bottom and the juxtaposed battery case wall. In this manner, a complete seal is provided to offer a total barrier against any vapors reaching the battery posts and cooperating internal portions of the terminal assembly.

Accordingly, one of the objects of the present invention is to provide an improved battery terminal assembly including a pair of interfitting members with opposed cam faces and provided with connecting means allowing for relative axial shifting of the cam faces to achieve a positive clamping of the assembly about a battery post.

Another object of the present invention is to provide an improved battery terminal assembly including inner and outer cylindrical members axially displaceable to provide clamping of the assembly about a battery post and provided with interior passageways in communication with the post to distribute protective grease or the like as introduced through at least one grease fitting in at least one of the members.

A further object of the present invention is to provide an improved battery terminal assembly including a pair of interfitting cylindrical housings with opposed cam faces and cooperating threads on the housings allowing of axial displacement therebetween to clampingly engage a battery post and form a complete shroud thereabout.

Still another object of the present invention is to provide an improved battery terminal assembly including inner and outer members interfitting by means of cooperating threads and relatively shiftable to provide a positive clamping upon a battery post and to present a completely airtight shrouding of the post.

Another object of the present invention is to provide an improved battery terminal assembly including a pair of interfitting and axially shiftable generally cylindrical members joined by cooperating threads and adapted to clampingly engage a battery post by the application of tools respectively engaging wrench flats on the two members.

A further object of the present invention is to provide an improved battery terminal assembly including threadedly connected cylindrical inner and outer members relative shiftable to clampingly engage a battery post and having an electrical cable attached to either the inner or outer member.

With these and other objects in view which will more readily appear as the nature of the invention is better understood, the invention consists in the novel construction, combination and arrangement of parts hereinafter more fully described, illustrated and claimed.

Preferred and practical embodiments of the invention are shown in the accompanying drawings, in which:

BRIEF DESCRIPTION OF THE DRAWINGS

Similar reference characters designate corresponding parts throughout the several views of the drawings.

DESCRIPTION OF THE PREFERRED EMBODIMENT

Figure 1:
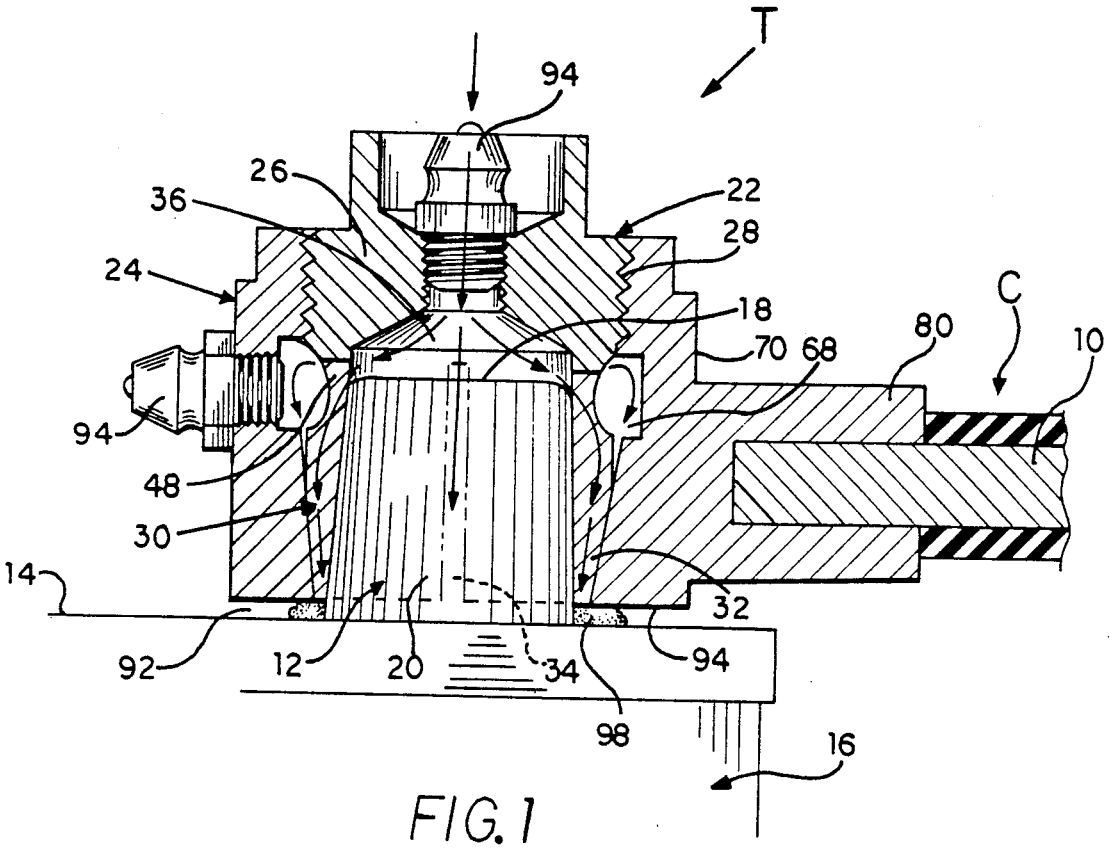
FIG. 1 is a side elevation, partly in section, of a battery terminal assembly according to the present invention.

Referring now to the drawings, particularly FIG. 1, the present invention will be seen to comprise a multi-part cable terminal assembly, generally designated T and which serves to provide an improved releasable attachment for an electrical cable C containing conductors 10, to the mounting post 12 extending from one wall 14 of a typical battery 16. Such posts 12 include a planar top wall 18 joined to an upwardly and inwardly tapered side wall 20 and heretofore, the most popular cable termination has comprised a bifurcated circular clamp having a slightly tapered inner surface and which is slipped over the post and secured thereto by a threaded fastener disposed through its free ends.

With the instant assembly T, an airtight, enshrouding enclosure is provided and which includes cooperating generally cylindrical inner and outer members 22, 24, respectively. The upper portion 26 of the inner member 22 is provided with shiftable engaging means in the form of external threads 28 on its outer, largest diameter periphery while the lower portion 30 of the inner member comprises a skirt as defined by a plurality of arcuate segments 32, each separated by an opening such as the illustrated longitudinal slot or passageway 34 extending from the upper chamber 36 of the post cavity 38 and through the bottom edge 40 of the segments 32. The inside surface 42 of the arcuate segments 32 are slightly inclined downwardly and outwardly for example, 2–3 degrees from the vertical, coincident with the taper of a typical battery post side wall 20.

On the other hand, the lower outside surface 44 of the arcuate segments 32 will be understood to be tapered downwardly and inwardly a more substantial amount, on the order of 7–8 degrees. Each such latter segment surface 44 depends from a central outside surface 46 which is substantially vertical while the upper area of the inner member lower portion 30 will be seen to include an external peripheral groove or passageway 48. As shown most clearly in FIG. 2, the top 50 of each of the plurality of slots or passageways 34 extend to a height radially coincident with the height of the groove 48 and thus, each of the slots 34 provides direct communication with the groove 48 for reasons which will become obvious hereinafter.

Figure 2:
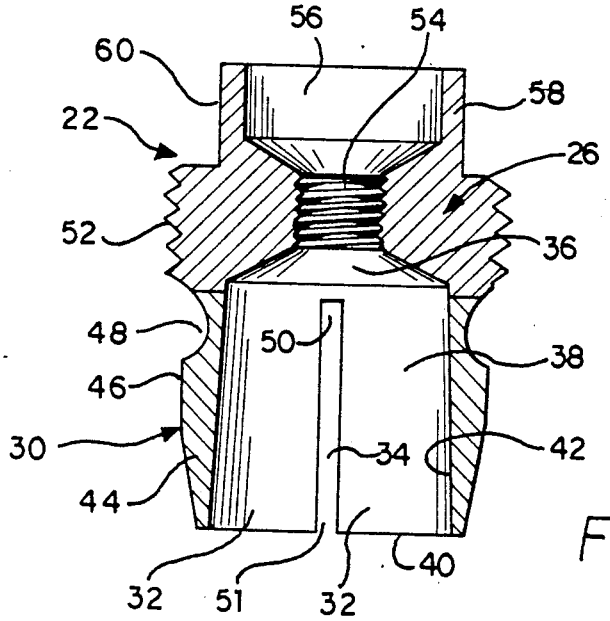
FIG. 2 is a vertical cross-section of the inner member of FIG. 1.

The upper portion 26 of the inner member 22 defines the greatest diameter of this member and is provided with external threads 52. In the embodiment of the inner member 22 as shown in FIGS. 1–2, the central area of the upper portion 26 may include an axially extending tapped bore 54 communicating with a topmost cavity 56 surrounded by a peripheral wall 58, the outer face of which is configured to form a plurality of wrench engageable flats 60. Alternatively, either two or four such flats 60 may be provided for accommodating an open end wrench or six flats offered to receive a well known socket type of wrench. The use of wrench means will be discussed hereinafter during the description of the operation of the assembly T.

Figure 3:
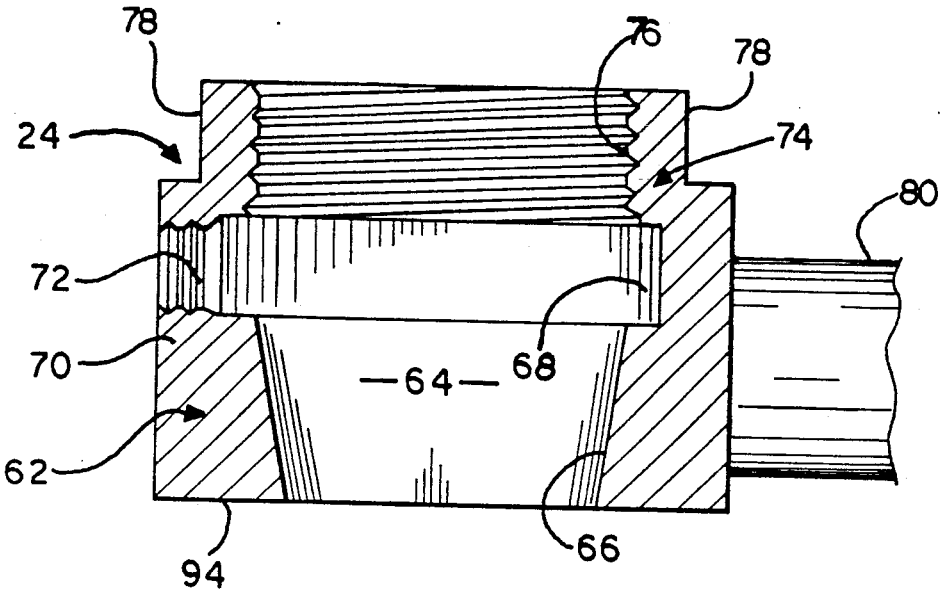
FIG. 3 is a vertical cross-section of the outer member of FIG. 1.

The above described inner member 22 is adapted to cooperate with the housing or outer member 24 illustrated in FIGS. 1 and 3 which includes a lower portion 62 having a tapered central cavity 64 as formed by the downwardly and inwardly inclined inner wall or inside surface 66, the inclination of which is preferably equal to that of the inner member tapered outside surface 44. A horizontally disposed inner groove or channel 68 is provided within the outer member 24, directly atop the tapered cavity 64, with an internal diameter slightly greater than that of the adjacent edge of the cavity 64. Extending through the outside surface 70 of the outer member is a tapped bore 72 communicating with the inner channel 68. As shown most clearly in FIG. 3, the upper portion 74 of the outer member includes a bore having internal threads 76 adapted to mate with the threads 52 of the inner member 22, with the threads 76 extending through to the adjacent channel 68 and presenting an internal diameter less than that of the channel. The outer surface of the upper portion 74 is formed with at least a pair of oppositely disposed wrench flats 78, 78, the function of which will be explained herebelow.

Means must be provided to obtain the attachment of an associated electrical cable with respect to either one of the assembly members 22 or 24. In the embodiment of FIGS. 1–3, this attachment is accomplished during manufacture of the assembly, by cable fixation means 80 comprising an extension or projection from the outside surface 70 of the outer member 24 and within which the cable conductors 10 are crimped or otherwise fixed thereto. It will be appreciated that the material selected for the construction of both members of the assembly is highly conductive and at least slightly malleable, such as lead.

Figure 4:
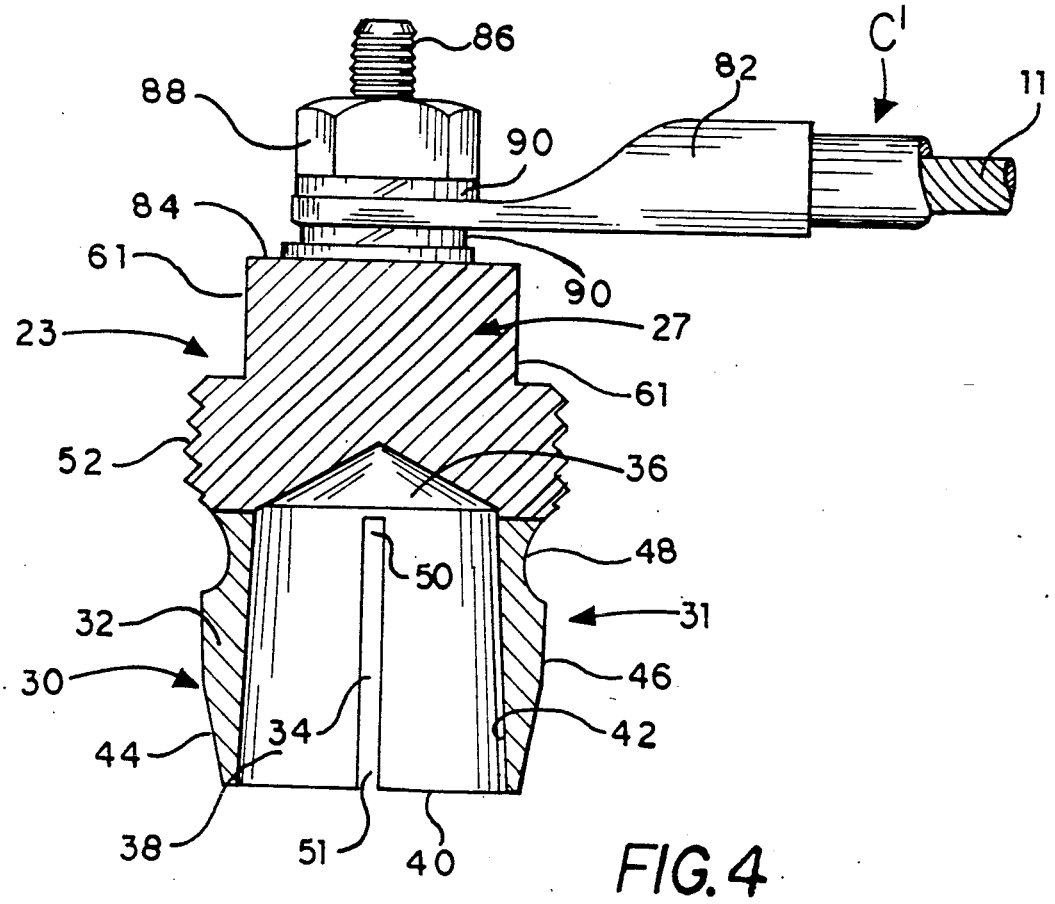
FIG. 4 is a side elevation, partly in section, of an alternate embodiment of the inner member.

An alternative manner of affixing an electrical cable to an assembly according to the present invention is shown in FIG. 4 of the drawings. In this instance, the cable C′ desired to be connected to a battery is of the type wherein the conductors 11 are suitably attached to a termination comprising an apertured lug 82. To accommodate such a termination, either the inner or outer member 22 or 24 must be provided with a suitable threaded stud adapted to receive the lug 82. FIG. 4 will be seen to illustrate an alternative inner member 23 wherein the lower portion 31 thereof is similar to the lower portion of the above described inner member 22 but includes a modified upper portion 27 devoid of any tapped bore and topmost cavity and instead, is of solid construction with a plurality of external wrench flats 61. Projecting upwardly from the top wall 84 is a conductive threaded stud 86, to which the cable termination 82 is connected by means of a nut 88, preferably with one or more lock washers 90.

The above described uniquely constructed inner and outer members 22, 24 are assembled and manipulated in a manner which assures a positive structural integrity and thus electrical continuity, between a battery post 12 and the conductors 10 or 11 of a connected cable. The assembly T is attached to a battery 16 by initially axially displacing the inner member 22 or 23 upwardly relative the outer member 24. It is not necessary to completely unscrew the two members from one another but merely to back off the inner member threads a small amount from the final, locked condition as shown in FIG. 1. In view of the tapered disposition of the juxtaposed inside surface 42 and post outer surface 20, it will be appreciated that a definite air gap (not shown) initially will exist between these two opposed surfaces, even after the assembly has been lowered so that the outer member 24 is closely spaced relative the battery wall 14 as shown in FIG. 1. Thereafter, while holding the outer member stationary, the inner member is rotated to advance its threads downwardly relative the coacting outer member threads 76. This latter action is facilitated by the use of appropriate wrenches (not shown) against the respective wrench flats 78 and 60 or 61. The downward axial displacement of the inner member 22 will be understood to result in a camming action as the inner member outside surface 44 engages the stationary outer member inner wall 66. Continued downward movement of the inner member forces the plurality of inner member segments 32 radially inwardly until the inside surfaces 44 thereof are tightly engaged with the battery post side wall 20. The tightened assembly T will then appear as in FIG. 1. The configuration of the two member components and the positioning thereof relative the battery 16 are selected to insure that when properly tightened, at least a slight space 92 exists between the bottom face 94 of the outer member 24 and the adjacent wall 14 of the battery.

The foregoing describes the attainment of a positive, mechanical connection of a cable to a battery post by the interaction of a pair of cooperating threaded members. As previously mentioned, a problem with most present battery cable clamping devices is that of corrosion, as caused by the attendant vapors of the acid electrolyte, which corrosion in the very area of the battery posts, is heightened due to the prevalent electrical field spanning the negative and positive battery posts.

With the instant assembly, a complete mechanical barrier or shroud is formed around each battery post 12 by the two interlocked members 22, 24 and additionally, means are included to introduce and retain, a viscous fluid compound such as lubricating grease so as to bathe and further protect the post and juxtaposed assembly components. It is well recognized that the application of a layer of lubricant upon the otherwise exposed areas of battery posts with conventional cable terminations, assists in discouraging the formation of corrosion. With the present invention, the protective shrouded environment as presented by the wedged together members, combines with the passageways therein to provide highly effective means for receiving, distributing and retaining a viscous lubricant serving to further protect the post and its attached assembly.

Following the anchorage of the assembly T to the post 12, grease is introduced into the interior of the assembly by way of a grease fitting valve 94 as mounted within either one of both of the two member bores 54, 72. Although a pair of these fittings 94 are shown in the assembly of FIG. 1, it will be appreciated that not necessarily will both fittings be necessary. Depending upon the environment of a specific battery installation, possibly only one such fitting will be accessible, in which case a slight savings in expense may be realized by omitting one of the tapped bores 54, 72 or substituting for one, a plug. In any case, it will be seen that as grease is injected through either fitting 94, the pressure associated with the grease application will cause the grease to pass through the inner member upper chamber 36, the continuous circular passage 96 between the outer member peripheral channel 68 and opposed inner member groove 48 and thence migrate down through the plurality of vertical slots or openings 34. This latter grease movement follows as the upper chamber 36 and passage 96 become filled with grease and continued input of grease forces it to enter the adjacent tops 50 of the vertical passageways 34. These top portions 50 of the slots 34 will be seen not only to be coplanar with and in direct communication with the circular passageway 96 but also are disposed above the post top wall 18 and in communication with the upper chamber 36 fully overlying the post top wall. Introduction of the grease continues until grease is observed to issue from the open bottoms 51 of the plurality of passageways 34 and which forms a final bottom seal 98. This seal 98 will be understood to migrate annularly as well as radially to form a complete bead or seal of grease surrounding the post 12 and vertically spanning the gap 92. This multi-directional flow is assured due to the elevated disposition of the bottom faces 40, 94 of the two members above the battery wall 14 and which allows grease being forced from the elevated passageway bottom openings 51 to flow in multi directions as it is vertically contained between the assembly T and battery 16.

The mounting of the assembly with the alternative inner member 23 of FIG. 4 is achieved in the same manner as above described. Quite obviously the connection of the cable termination 82 will be accomplished following the rotation of the inner member 23 into the locked condition. Thereafter, grease will be introduced through the same side mounted grease fitting 94 in the outer member 24 to complete the installation.

We claim:

1. In a cable terminal assembly for attachment to a battery post having a top wall the improvement comprising:

a one-piece outer member having upper and lower portions and including a cavity in said lower portion bounded by an inside surface, said upper portion provided with a through bore axially aligned with said cavity and said outer member having an outside surface, a one-piece inner member insertable within said outer member and having upper and lower portions, said inner member lower portion including a skirt having an inside surface surrounding a central post cavity normally defining a configuration adapted to encompass said battery post, said skirt provided with an outside surface and having a plurality of longitudinally extending slots therethrough, said inner member including an upper area defining an upper chamber communicating with said central post cavity and disposed above said battery post top wall when said inner member skirt encompasses said battery post, said slots each having an upper portion communicating with said inner member upper chamber.

mating threads on said outer and inner member upper portions connecting said inner member to said outer member when said inner member is threadably inserted within said outer member and operable to axially displace said inner member downwardly relative said outer member as said inner member skirt inside surface surrounds said battery post and said skirt outer surface engages said outer member inside surface, fixed integral wrench engaging means on said inner and outer member upper portions permitting actuation of said inner and outer member upper portion mating threads, said outer member inside surface and said inner member skirt outer surface each containing cooperating downward and inward tapers, said cooperating tapers on said inner and outer member lower portions operable to radially and inwardly displace said inner member skirt as said mating threads are actuated to axially displace said inner member downwardly relative said outer member, said inner and outer members defining a circular passageway therebetween, said circular passageway encircling said inner member in a plane radially adjacent said slot upper portions, a passage through each of said inner and outer members providing communication from without said assembly respectively to said upper chamber or said circular passageway, each said passage containing a grease fitting valve, each said grease fitting valve permitting pressure injection of a fluid protective substance therein and thence through one of said upper chamber or said circular passageway, respectively, and thence into said slots, said fluid protective substance thus coating said battery post contained within said assembly, and means connecting an electrical cable to said outer member outside surface, whereby actuation of said mating threads achieves a fixed attachment of said assembly and its connected electrical cable to said battery post.

2. A cable terminal assembly according to claim 1 wherein, said inner member skirt includes a bottom edge, and said skirt slots passing through said skirt bottom edge.

* * * * *